US011305971B2

(12) United States Patent
Liu

(10) Patent No.: US 11,305,971 B2
(45) Date of Patent: Apr. 19, 2022

(54) LIFTING DEVICE

(71) Applicant: Chia-Ming Liu, Douliou (TW)

(72) Inventor: Chia-Ming Liu, Douliou (TW)

( * ) Notice: Subject to any disclaimer, the term of this patent is extended or adjusted under 35 U.S.C. 154(b) by 258 days.

(21) Appl. No.: 16/689,441

(22) Filed: Nov. 20, 2019

(65) Prior Publication Data

US 2020/0361755 A1 Nov. 19, 2020

(30) Foreign Application Priority Data

May 17, 2019 (CN) ..... 201920715747.3

(51) Int. Cl.
*B66F 3/10* (2006.01)
*A47B 9/20* (2006.01)

(52) U.S. Cl.
CPC . *B66F 3/10* (2013.01); *A47B 9/20* (2013.01)

(58) Field of Classification Search
CPC .. B25H 1/16; B25H 3/028; A47B 9/04; B66F 3/10; B66F 3/08; B66F 3/28; F16H 57/0497; F16H 25/20
See application file for complete search history.

(56) References Cited

U.S. PATENT DOCUMENTS

| | | | | |
|---|---|---|---|---|
| 9,827,662 | B1 * | 11/2017 | Liu | B25H 1/16 |
| 10,531,732 | B1 * | 1/2020 | Huang | A47B 9/20 |
| 2013/0014677 | A1 * | 1/2013 | Jussila | B66F 11/04 108/147 |
| 2018/0172062 | A1 * | 6/2018 | Hu | H02K 5/24 |
| 2018/0177288 | A1 * | 6/2018 | Lin | H02K 7/06 |
| 2019/0357668 | A1 * | 11/2019 | Knudtson | A47B 9/20 |
| 2020/0085184 | A1 * | 3/2020 | Lu | A47B 9/04 |
| 2021/0341257 | A1 * | 11/2021 | Mock | F41G 1/35 |

* cited by examiner

*Primary Examiner* — Mahdi H Nejad
(74) *Attorney, Agent, or Firm* — Rosenberg, Klein & Lee

(57) ABSTRACT

A lifting device includes a guide unit, a support unit and a lifting unit. The guide unit is extendable and retractable along a direction. The support unit is disposed in the guide unit and includes a securing connector fixed to a seat body and made of elastic material, a support tube connected to the securing connector, and a support member disposed on the support tube. The lifting unit includes a first rod-actuating screw member disposed on the support member and having a first threaded hole, and a threaded rod unit including a first threaded rod extending into the support tube and being threadedly engaged with the first threaded hole, such that the first threaded rod is rotatable by an external force and movable in the direction.

13 Claims, 10 Drawing Sheets

LIFTING DEVICE

CROSS-REFERENCE TO RELATED APPLICATION

This application claims priority of Chinese Utility Model Patent Application No. 201920715747.3, filed on May 17, 2019.

FIELD

The disclosure relates to a lifting device, and more particularly to a lifting device drivable to move a carrier.

BACKGROUND

Referring to FIG. 1, U.S. Pat. No. 9,815,189 B1 discloses a conventional tool cabinet including a cabinet body 91, a working platform unit 92 disposed on the cabinet body 91, two lifting units 93 (only one is shown in FIG. 1), and a driving unit 94 mounted to the working platform unit 92. The cabinet body 91 includes a top wall 911, and two vertical guide rails 912 (only one is shown in FIG. 1) that are spaced apart from each other. The working platform unit 92 includes a platform member 921 that is disposed above the top wall 911, and two extension members 922 (only one is shown in FIG. 1) that are connected to the platform member 921 and that are respectively and slidably engaged with the vertical guide rails 912. The working platform unit 92 is operable to move upward or downward relative to the top wall 911 of the cabinet body 91. Each of the lifting units 93 includes a guide tube 931 that is connected to the cabinet body 91 and that extends into a respective one of the vertical guide rails 912, a support member 932 that is fixed to a top end of the guide tube 931, a threaded member 933 that is received in a respective one of the extension members 922, that is disposed on the support member 932 and that has an inner threaded hole 936, and a threaded rod 934 that is rotatably mounted to the working platform unit 92, that is engaged with the inner threaded hole 936 of the threaded member 933. The driving unit 94 includes a driving motor 941 that is operable to drive rotation of the threaded rod 934 of each of the lifting units 93, such that the threaded rod 934 of each of the lifting units 93 carries the working platform unit 92 to move upward or downward. However, such configuration may produce unwanted noises caused by collision among the threaded rod 934, the guide tube 931, support member 932 of each of the lifting units 93 and its corresponding extension member 922.

SUMMARY

Therefore, an aspect of the disclosure is to provide a lifting device that can alleviate the drawback of the prior art.

The lifting device is adapted for being connected between a seat body and a carrier, and is drivable to move the carrier upward or downward relative to the seat body.

The lifting device includes a guide unit, a support unit and a lifting unit. The guide unit is adapted for being connected between the seat body and the carrier. The guide unit is extendable and retractable along a top-bottom direction and defines an inner space extending along the top-bottom direction. The support unit is disposed in the inner space and includes a securing connector, a support tube and a support member. The securing connector is adapted for being fixed to the seat body and is made of an elastic material. The support tube has a bottom portion connected to the securing connector, and extends along the top-bottom direction. The support member is disposed at a top portion of the support tube and has a connecting hole which is spatially communicated with the inside of the support tube. The lifting unit includes a first rod-actuating screw member and a threaded rod unit. The first rod-actuating screw member is disposed on the support member inside the inner space, and has a first threaded hole aligned with the connecting hole. The threaded rod unit is adapted for being connected to the carrier and includes a first threaded rod which extends through the first threaded hole into the support tube, and which is threadedly engaged with the first threaded hole of the first rod-actuating screw member in such a manner that the first threaded rod is rotatable by an external force and movable along the top-down direction. All of the first rod-actuating screw member, the support member and the guide unit have identical cross sectional shapes which are non-circular.

BRIEF DESCRIPTION OF THE DRAWINGS

Other features and advantages of the disclosure will become apparent in the following detailed description of the embodiments with reference to the accompanying drawings, of which.

DETAILED DESCRIPTION

Figure 1:
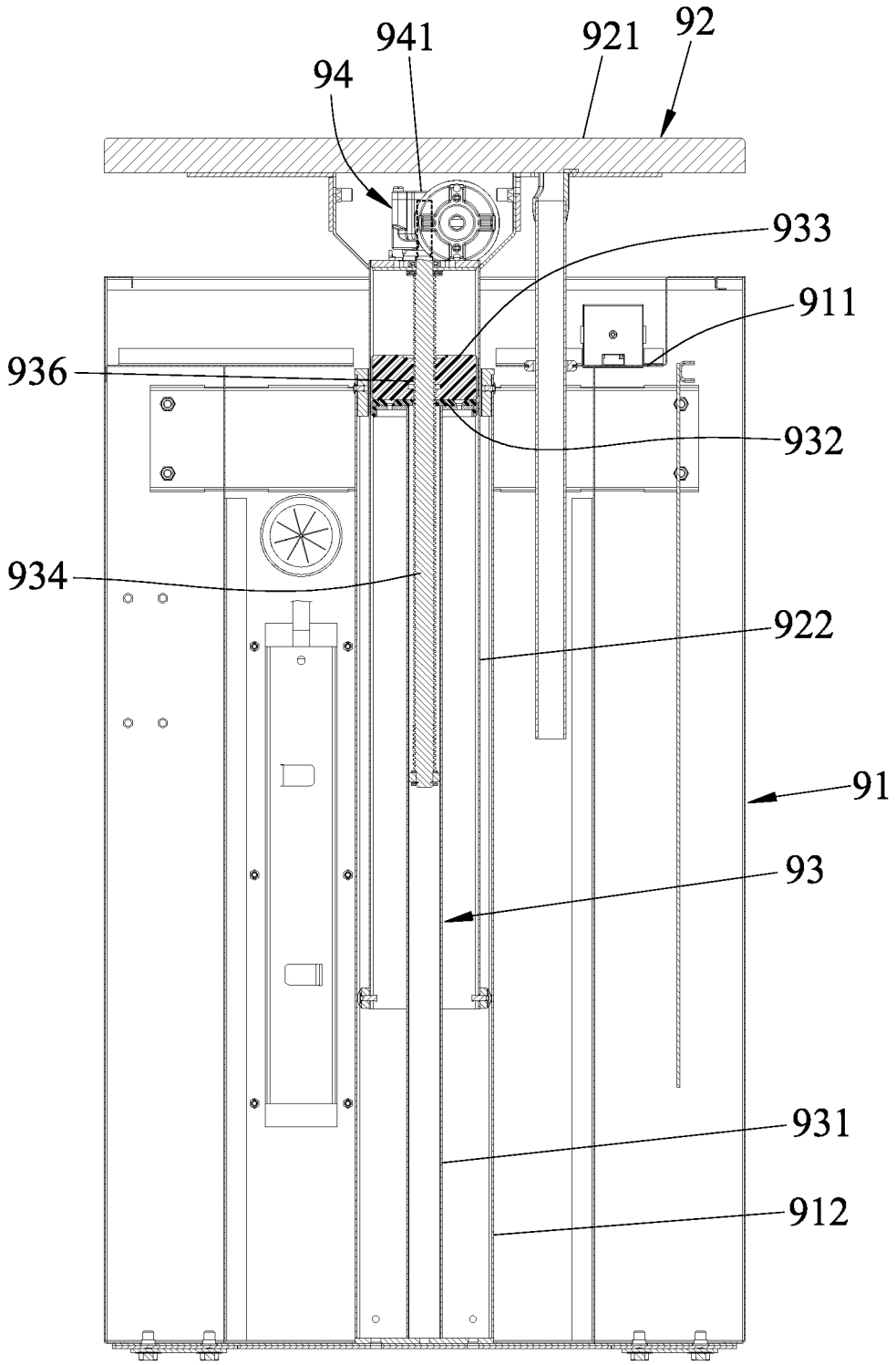
FIG.1 PRIOR ART
FIG. 1 is a partly sectional view of a conventional tool cabinet disclosed by U.S. Pat. No. 9,815,189 B1.

Before the disclosure is described in greater detail, it should be noted that where considered appropriate, reference numerals or terminal portions of reference numerals have been repeated among the figures to indicate corresponding or analogous elements, which may optionally have similar characteristics.

Figure 2:
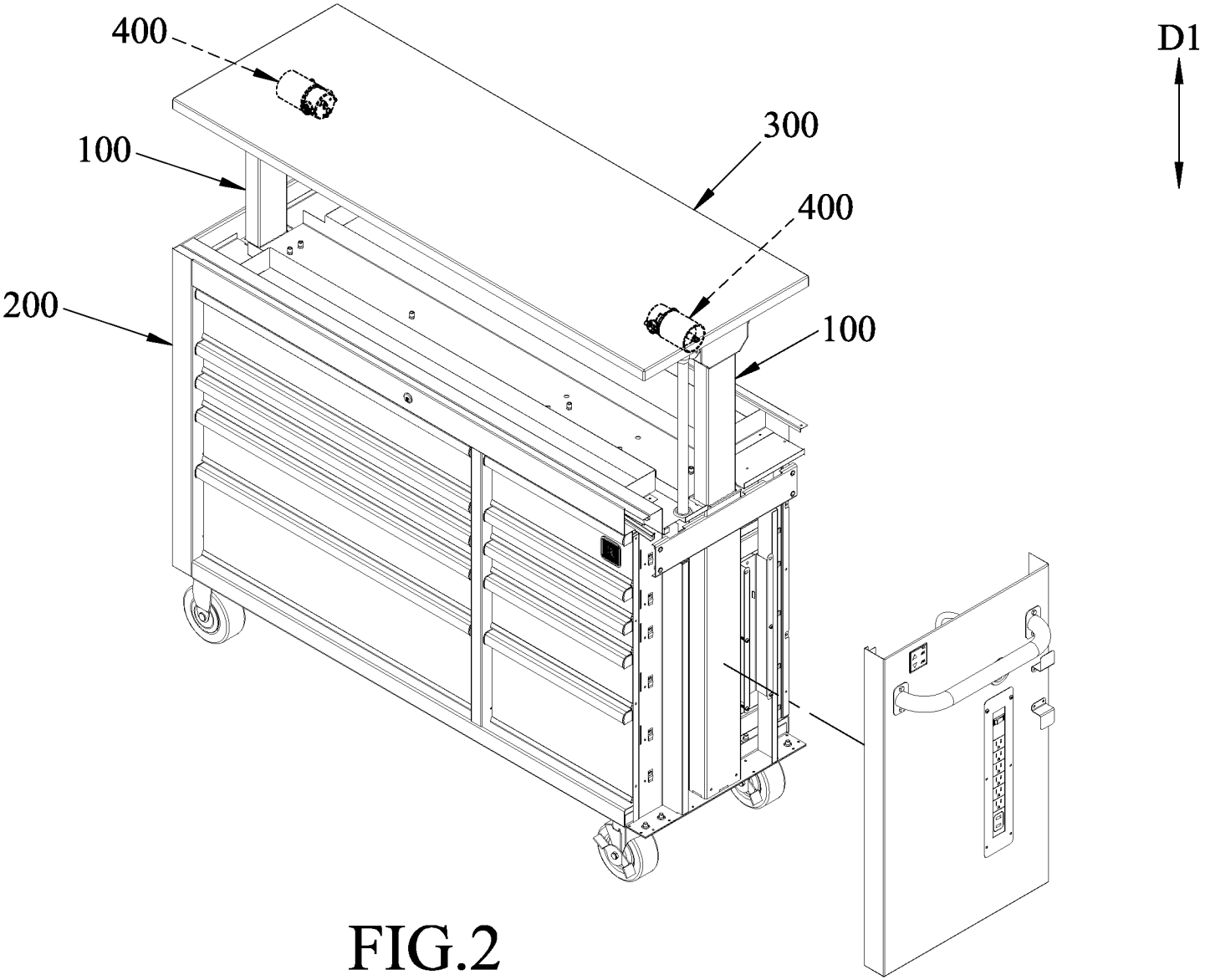
FIG. 2 is a schematic and partly exploded perspective view, incorporating two lifting devices of the first embodiment according to the disclosure, which are connected between a seat body and a carrier of a tool cabinet.

Referring to FIG. 2, a tool cabinet incorporating two lifting devices 100 of the first embodiment according to the present disclosure is illustrated. The two lifting devices 100 are shown to be connected between a seat body 200 and a carrier 300 of the tool cabinet. The tool cabinet includes two driving units 400 that are operable to respectively drive the lifting devices 100 to move upward or downward relative to the seat body 200 in a top-bottom direction (D1). In should be noted that the lifting devices 100 may be used in devices other than the tool cabinet. For example, the seat body 200 may be a base of a working table, and the carrier 300 may be a desktop of the working table. Each of the driving units 400 includes a motor and a gear set. In other examples, each of the driving units 400 may include a handle and the gear set, which can be manually driven by the handle.

Since the structures of the lifting devices 100 are identical to each other, only one of the lifting devices 100 is described hereinafter for the sake of brevity.

Referring to FIGS. 3 to 6, the lifting device 100 includes a guide unit 1, a support unit 2 and a lifting unit 3. The guide unit 1 is adapted for being connected between the seat body 200 and the carrier 300, is extendable and retractable along the top-bottom direction (D1), and defines an inner space 10 extending along the top-bottom direction (D1). The guide unit 1 includes a first guide tube 11, a second guide tube 12 and a guide sleeve 13. The first guide tube 11 extends along the top-bottom direction (D1), is adapted for being connected to the seat body 200, and has a top portion defining an upwardly-facing opening 111. The guide sleeve 13 is disposed inside and connected to the top portion of the first guide tube (11) adjacent to the upwardly-facing opening 111. The second guide tube 12 is adapted for being connected to the carrier 300, slidably extends through the guide sleeve 13 into the first guide tube 11, and cooperates with the first guide tube 11 to define the inner space 10.

The support unit 2 is disposed in the inner space 10, and includes a securing connector 21, a support tube 22 and a support member 23. The securing connector 21 is adapted for being fixed to the seat body 200, and is made of an elastic material. In this embodiment, the securing connector 21 is made of polyamide 6 (also known as PA 6 or nylon 6). The support tube 22 has a bottom portion that is connected to the securing connector 21, and extends along the top-bottom direction (D1). The support member 23 is disposed at a top portion of the support tube 22, and has a connecting hole 231 which is spatially communicated with the inside of the support tube 22.

In this embodiment, the support unit 2 further includes two first fasteners 24, a securing plate 25 and a second fastener 26. The securing connector 21 has a main body portion 211 that is disposed inside the support tube 22 in abutment with an inner tube surface 221 of the support tube 22, a flange portion 212 that protrudes laterally from the main body portion 211 and is disposed outwardly from the support tube 22 to abut against a bottom edge of the support tube 22, and an extending portion 213 that extends downwardly from a bottom portion of the main body portion 211. The first fasteners 24 secure the main body portion 211 of the securing connector 21 to the support tube 22. In this embodiment, the two first fasteners 24 are screws. However, the number of the first fasteners 24 may be varied to be one or more than two, based on practical requirements. The securing plate 25 is disposed below the support tube 22 to abut against the securing connector 21, is adapted for being connected to the seat body 200 by screws or bolts (not shown), and has a through hole 251 to receive and engage with the extending portion 213 of the securing connector 21. The second fastener 26 extends into the extending portion 213 of the securing connector 21 to secure the securing connector 21 to the securing plate 25.

The lifting unit 3 includes a first rod-actuating screw member 31 and a threaded rod unit 32. The first rod-actuating screw member 31 is disposed on the support member 23 inside the inner space 10, and has a first threaded hole 311 aligned with the connecting hole 231 of the support member 23. The threaded rod unit 32 is adapted for being connected to the carrier 300, and includes a first threaded rod 321 which is rotatably connected to the carrier 300, which extends through the first threaded hole 311 into the support tube 22, and which is threadedly engaged with the first threaded hole 311 of the first rod-actuating screw member 31 in such a manner that the first threaded rod 321 is rotatable by an external force (i.e., a driving force from one of the driving units 400) and is movable along the top-bottom direction (D1). In this embodiment, the threaded rod unit 32 of the lifting unit 3 further includes an annular sleeve 322 that is sleeved on a bottom portion of the first threaded rod 321 and that is disposed between the first threaded rod 321 and the support tube 22 to prevent the first threaded rod 321 of the threaded rod unit 32 from colliding the support tube 22.

Figure 3:
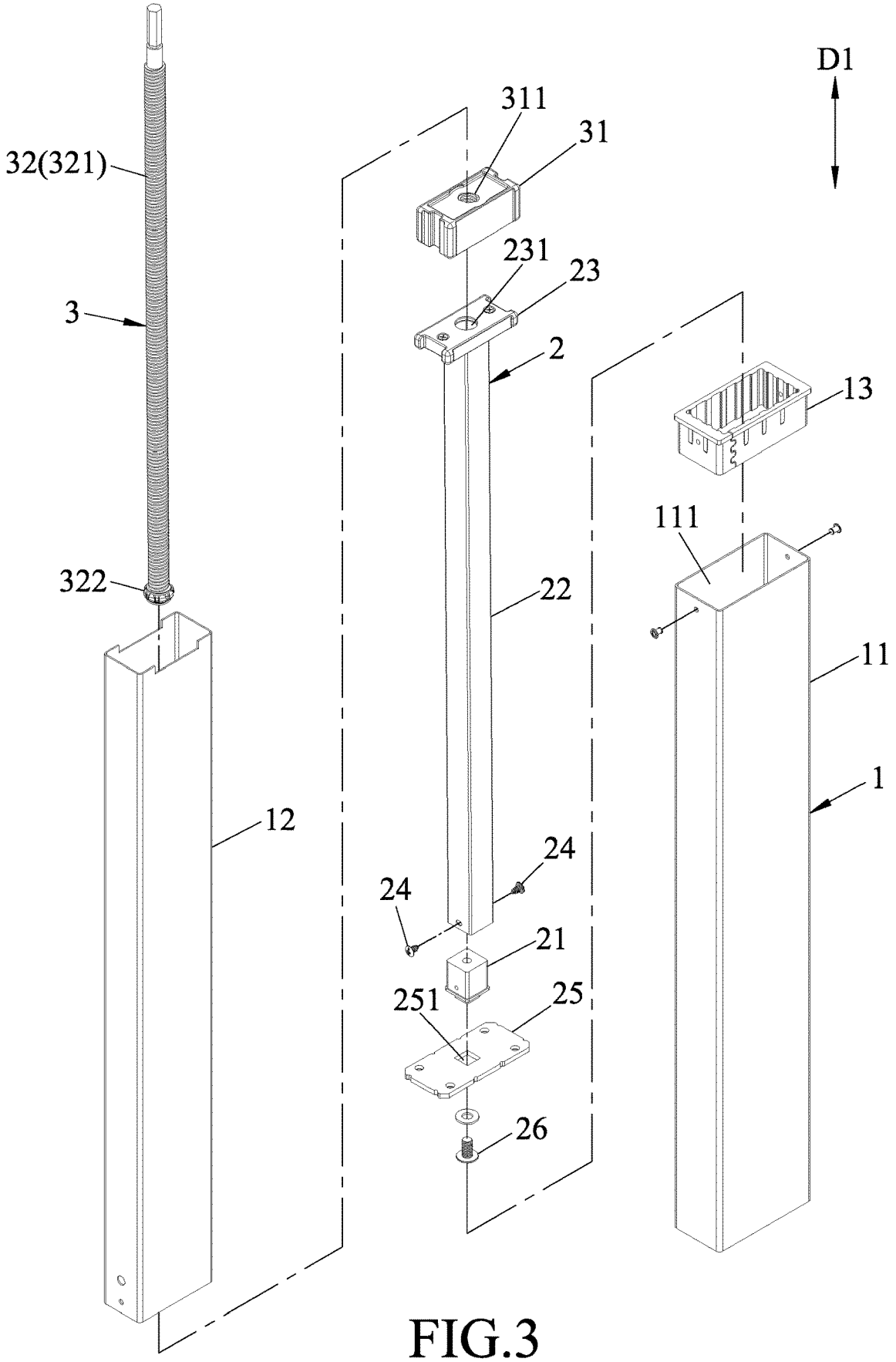
FIG. 3 is an exploded perspective view of one of the lifting devices of the first embodiment.
Figure 4:
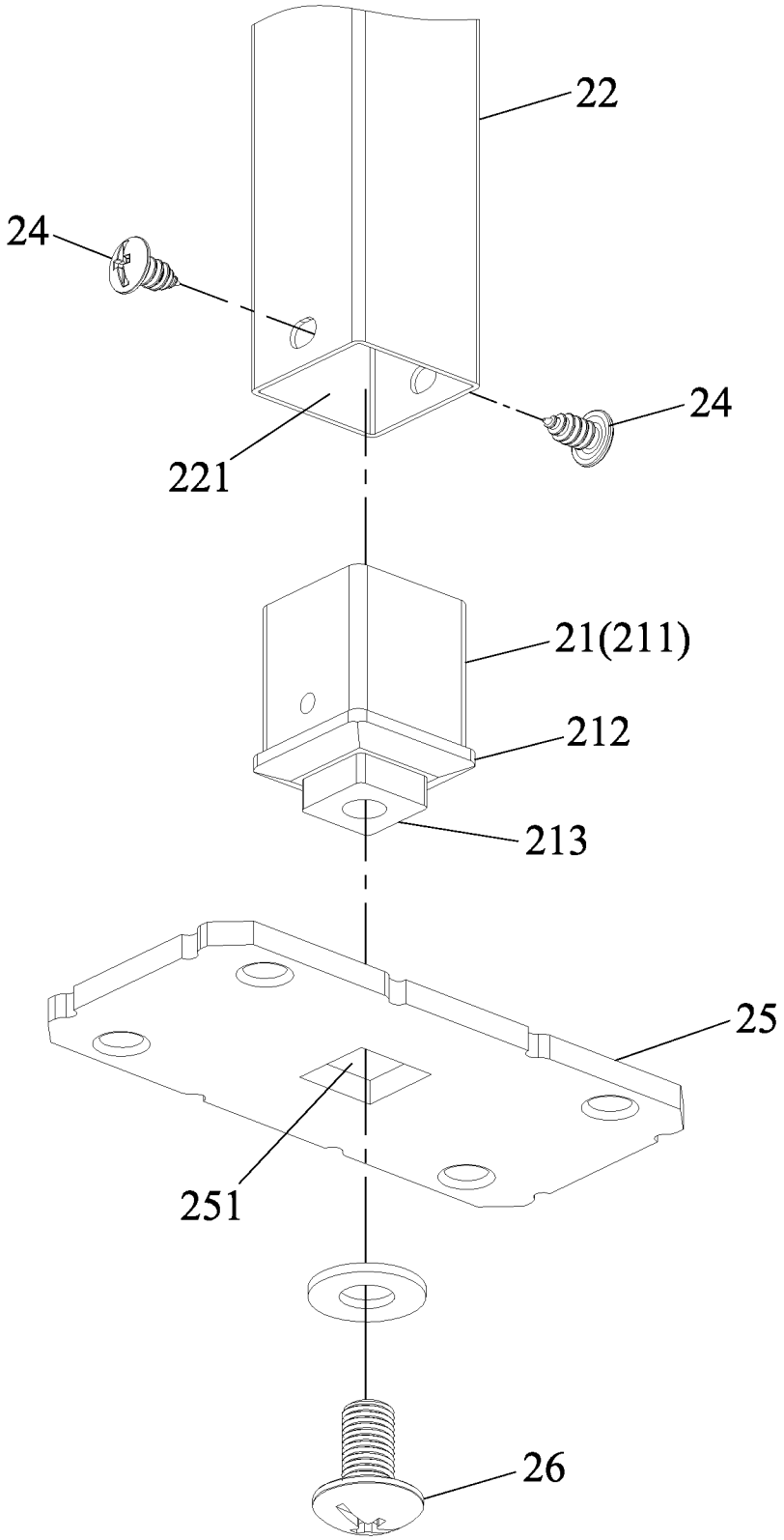
FIG. 4 is a fragmentary and exploded perspective view of the first embodiment.

Referring to FIG. 3, all of the first and second guide tubes 11, 12 of the guide unit 1, the support member 23 of the support unit 2, and the first rod-actuating screw member 31 of the lifting unit 3 have identical cross sectional shapes which are non-circular, and, in this embodiment, all of them are rectangular in cross section. Because of the identical rectangular cross section, the first and second guide tubes 11, 12, the support member 23, and the first rod-actuating screw member 31 have cross sections that are substantially the same and are prevented from rotation during their relative movements in the top-bottom direction (D1).

Figure 5:
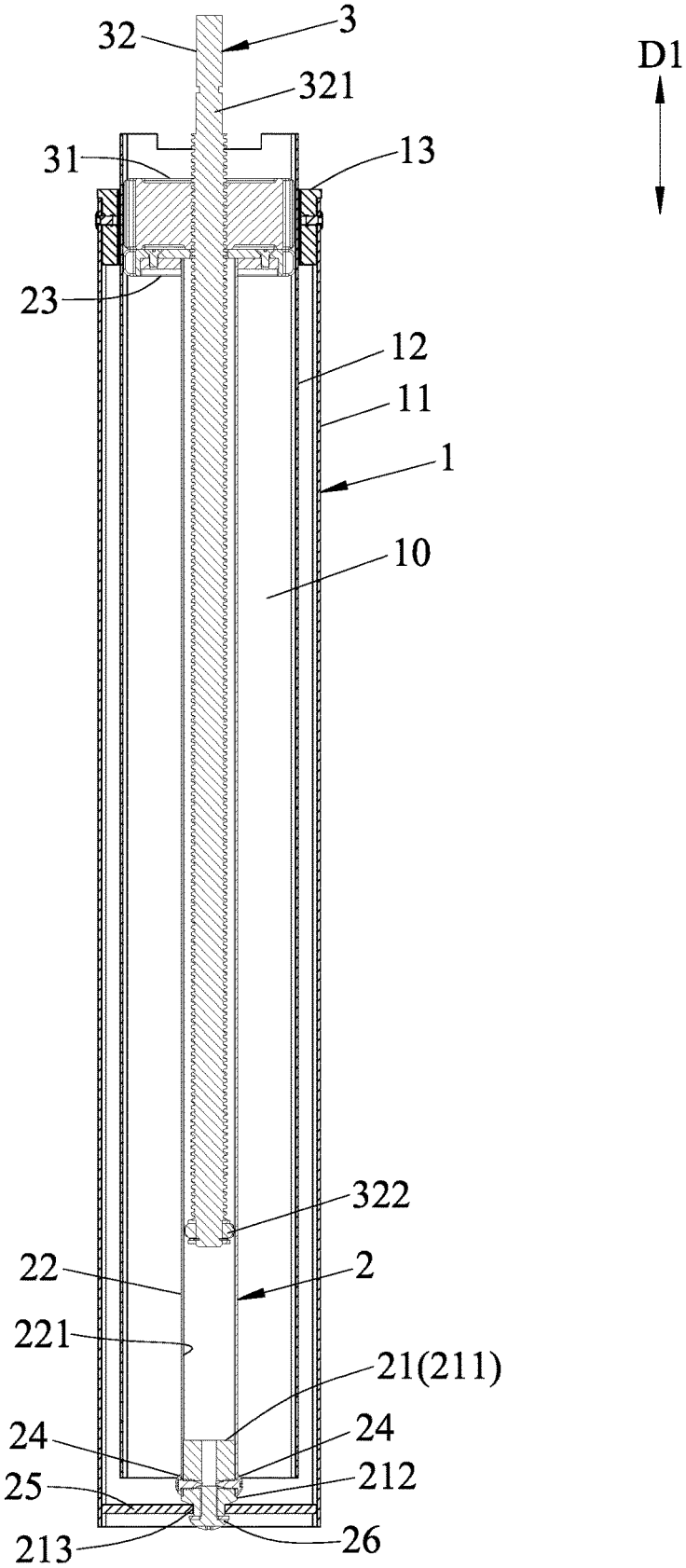
FIG. 5 is a sectional view of the first embodiment, showing the lifting device being in a lowered state.
Figure 6:
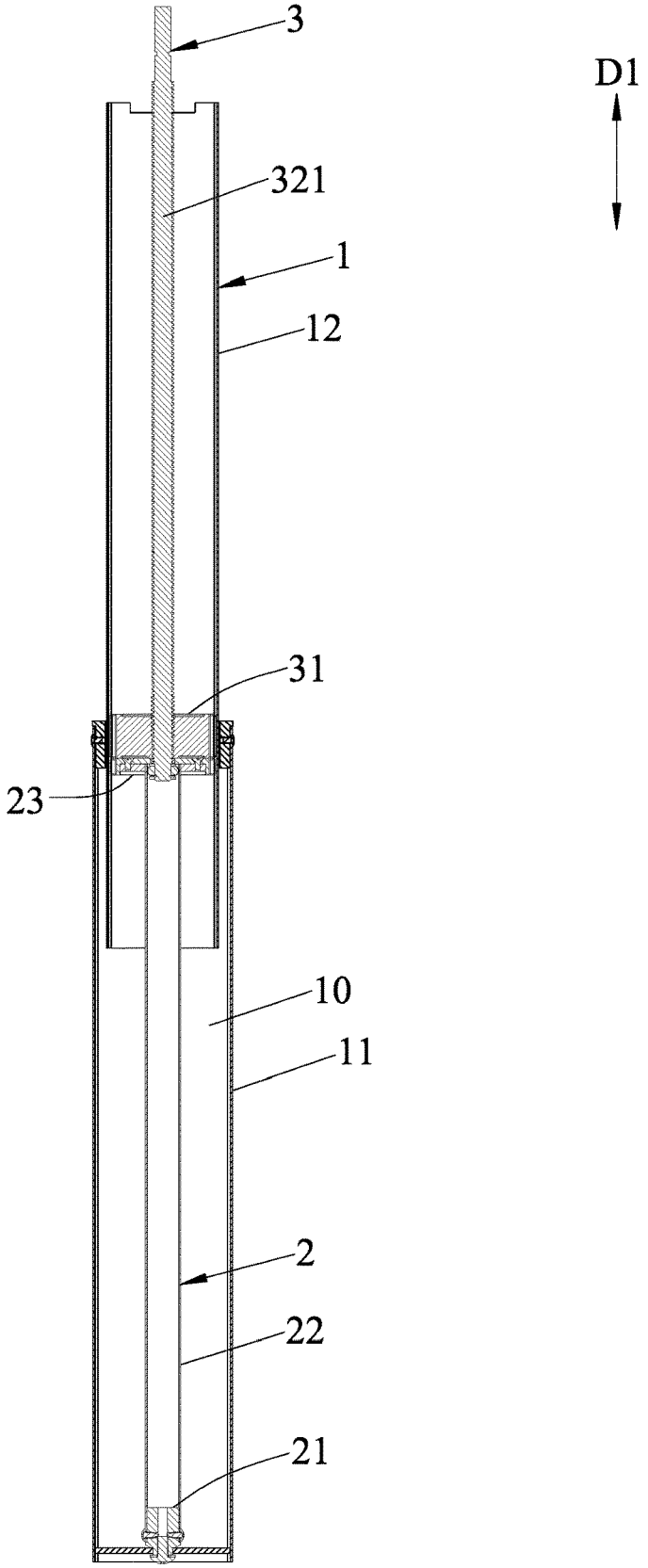
FIG. 6 is a sectional view of the first embodiment, showing the lifting device being in a raised state.
Figure 7:
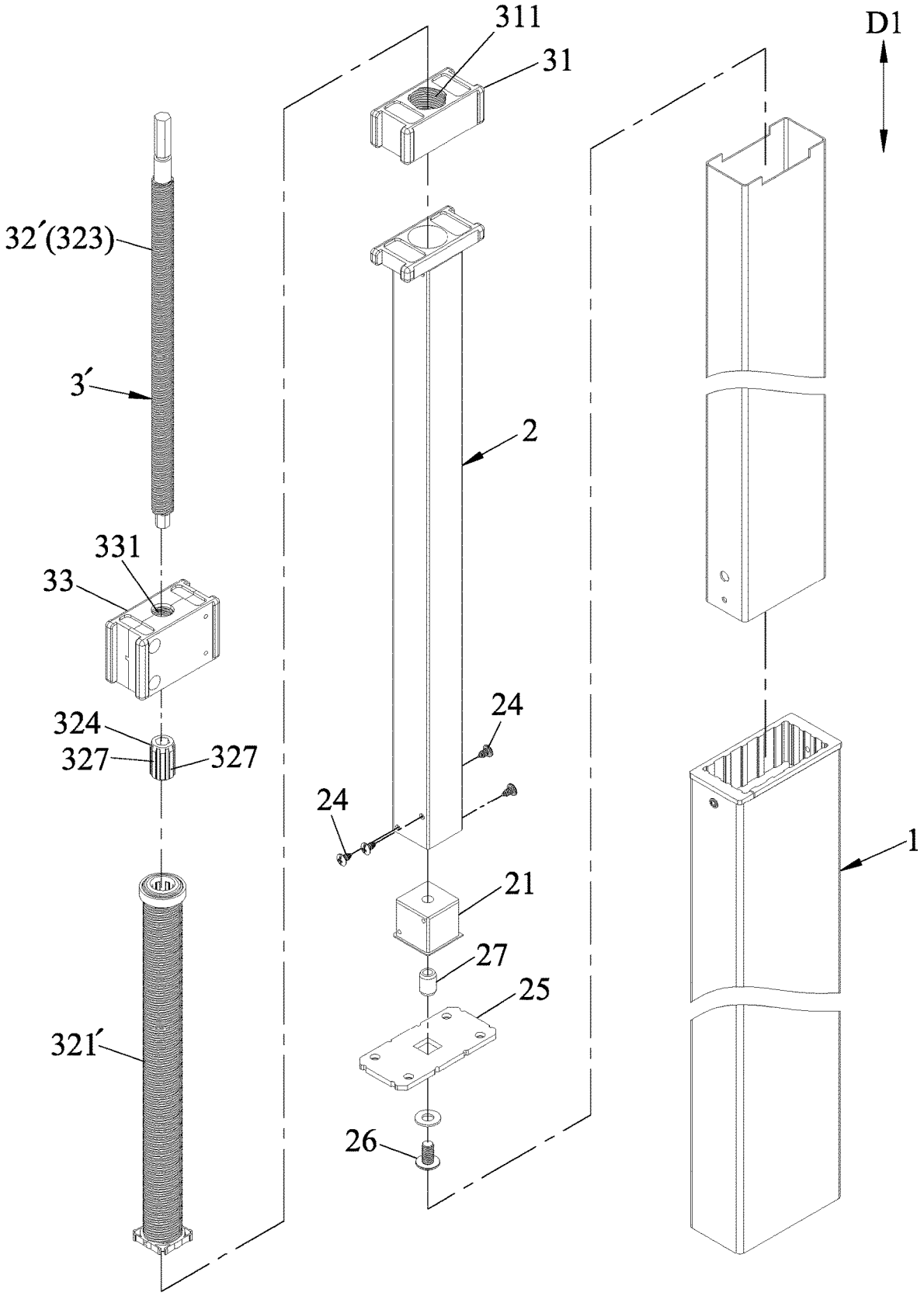
FIG. 7 is an exploded and partly perspective view of one of the lifting device of the second embodiment according to the present disclosure.
Figure 8:
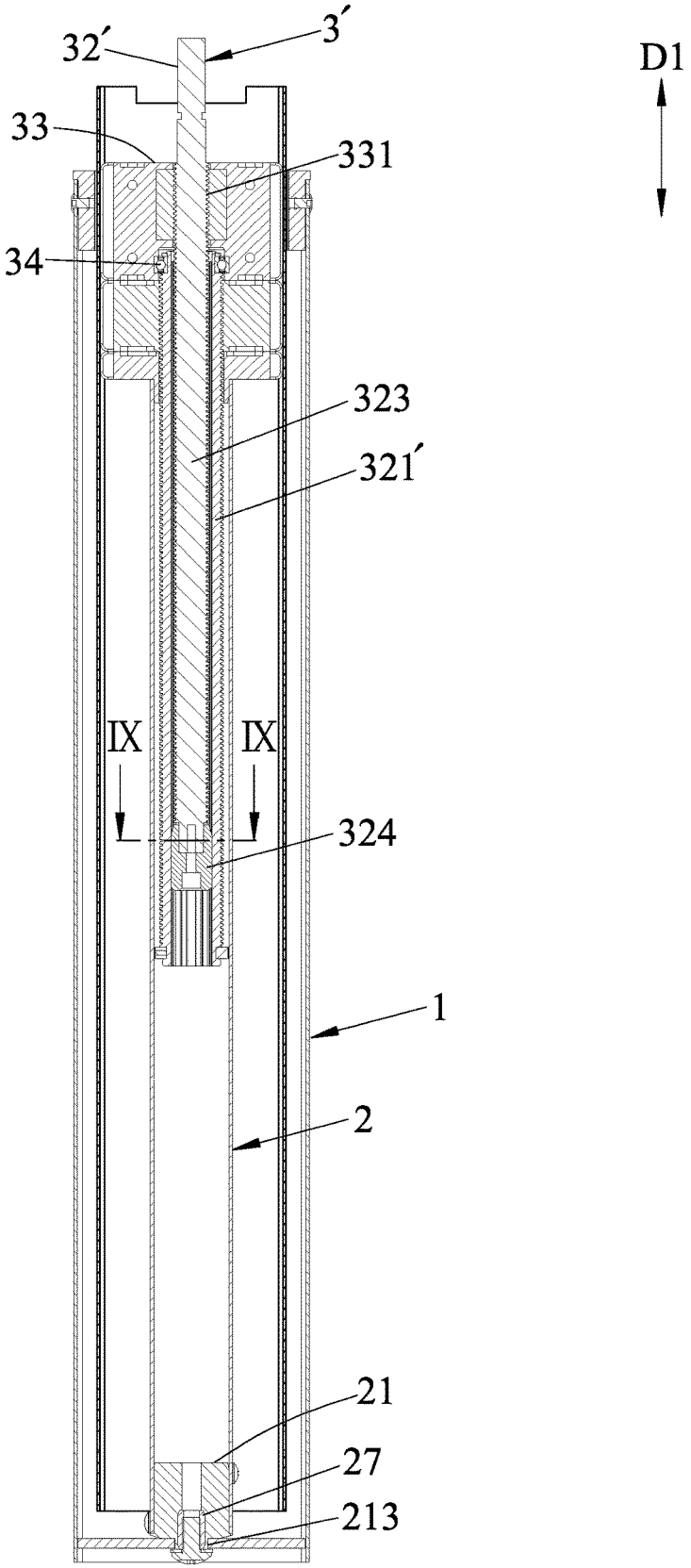
FIG. 8 is a sectional view of the second embodiment, showing the lifting device being in a lowered state.
Figure 9:
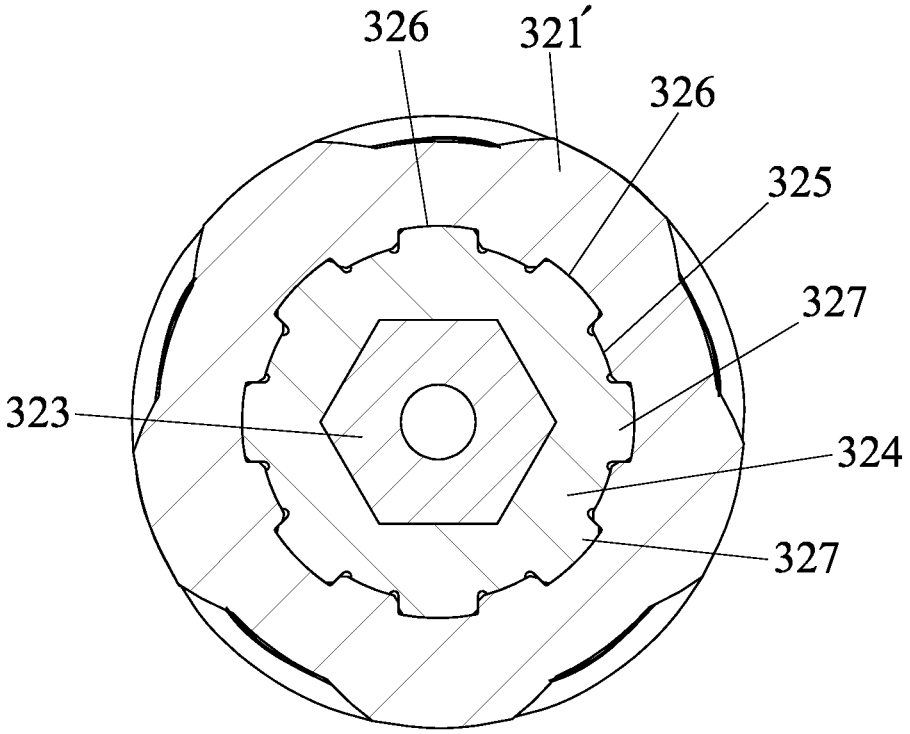
FIG. 9 is a sectional view of the second embodiment taken along line IX-IX of FIG. 8.
Figure 10:
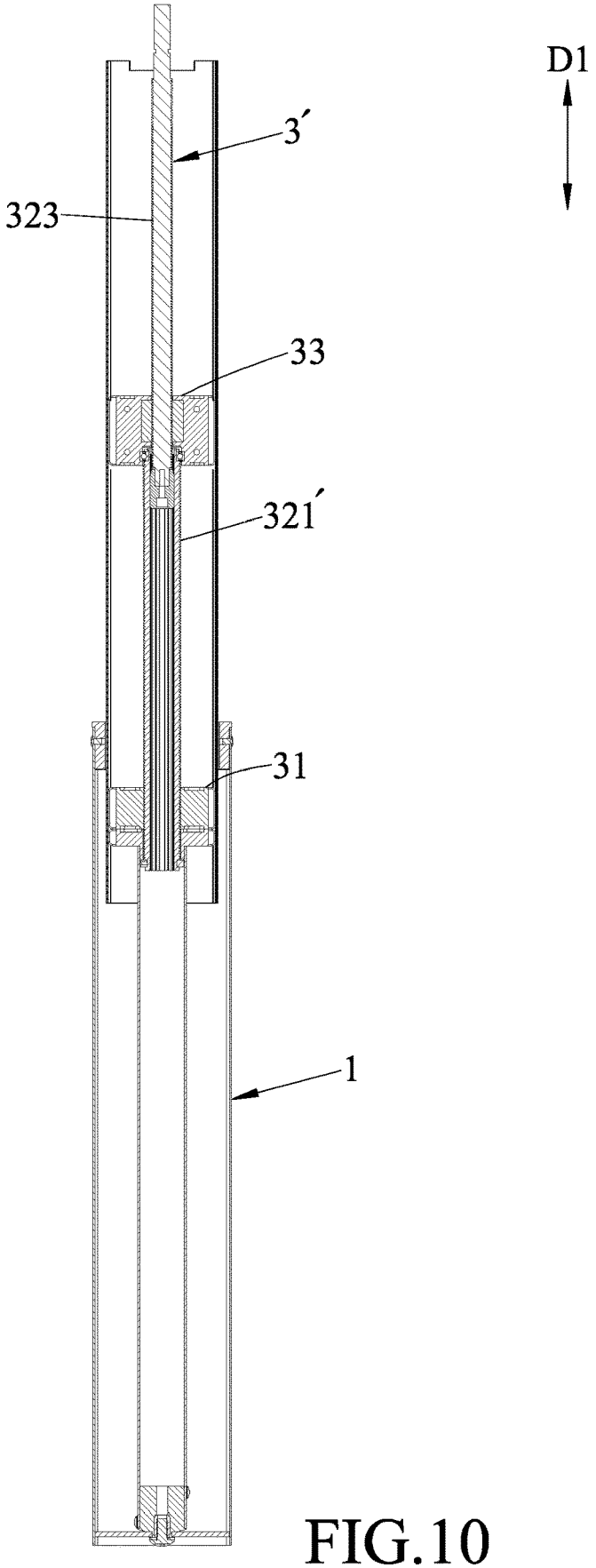
FIG. 10 is a sectional view of the second embodiment, showing the lifting device being in a raised state.

Referring to FIGS. 3, 5 and 6, when in use, a user can operate the driving unit 400 to drive the first threaded rod 321 of the threaded rod unit 32 to rotate relative to the first rod-actuating screw member 31. Due to the threaded engagement between the first threaded rod 321 and the first threaded hole 311 of the first rod-actuating screw member 31, the rotating first threaded rod 321 linearly moves along the top-bottom direction (D1), such that the lifting device 100 changes between a lowered state (see FIG. 5) and a raised state (see FIG. 6) to raise or lower the carrier 300 relative to the seat body 200. Meanwhile, the second guide tube 12 co-moves with the carrier 300 to move telescopically along the top-bottom direction (D1) relative to the first guide tube 11. The guide sleeve 13 guides movements of the second guide tube 12 and prevents the second guide tube 12 from colliding the first guide tube 11, and the annular sleeve 322 prevents the first threaded rod 321 from colliding the support tube 22.

Moreover, since the securing connector 21 is elastic, it is capable of absorbing the vibration of the support tube 22 and the support member 23, thereby reducing the stresses that cause the support member 23 to hit the second guide tube 12 and hence the noises resulting from the rubbing between the guide sleeve 13 and the guide tube 12. In addition, the elastic securing connector 21 allows the support tube 22 to slightly tilt about the bottom end of the support tube 22 as a fulcrum when being subjected to a load, thereby compensating assembly tolerance between the support tube 22 and the first threaded rod 321. The smoothness of the operation of the lifting device 100 can thus be improved.

FIGS. 7 to 10 illustrate a second embodiment of the lifting device 100 according to the present disclosure, which has a structure similar to that of the first embodiment except the differences described hereinafter.

In the second embodiment, the support unit 2 includes four of the first fasteners 24, and the support unit 2 further includes a nut 27 that is connected to the extending portion 213 of the securing connector 21 for the second fastener 26 to be fixed to the nut 27.

In the second embodiment, the first threaded rod 321' of the threaded rod unit 32' of the lifting unit 3' is hollow, and has an inner surface 325 that defines a plurality of guiding grooves 326 each extending along the top-bottom direction (D1). The lifting unit 3' further includes a second rod-actuating screw member 33 that is fixed to a top portion of the first threaded rod 321', that is capable of permitting rotation of the first threaded rod 321', and that has a second threaded hole 331. The threaded rod unit 32' further includes a second threaded rod 323 and a coupling member 324. The second threaded rod 323 of the threaded rod unit 32' extends into the first threaded rod 321' and threadedly engages the second threaded hole 331 of the second rod-actuating screw member 33, and has atop end adapted for being connected to the carrier 300. The coupling member 324 of the threaded rod unit 32' is connected to a bottom end of the second threaded rod 323 and has a plurality of protruding blocks 327 which are respectively and slidably engaged with the guiding grooves 326 of the first threaded rod 321'. In this embodiment, the lifting unit 3 further includes a ball bearing 34 that is connected between the second rod-actuating screw member 33 and the first threaded rod 321' to permit rotation of the first threaded rod 321' without translational motion relative to the second rod-actuating screw member 33.

When the second embodiment is in use, the user can operate the driving unit 400 to drive the second threaded rod 323 to rotate relative to the second rod-actuating screw member 33 and to drive rotation of the coupling member 324, which in turn cause the first threaded rod 321' to rotate, such that the first threaded rod 321' and the second threaded rod 323 move telescopically along the top-bottom direction (D1). Therefore, the lifting device 100 changes between a lowered state (see FIG. 8) and a raised state (see FIG. 10) to raise or lower the carrier 300 relative to the seat body 200.

All of the guide unit 1, the support member 23 of the support unit 2, and the first rod-actuating screw member 31 and the second rod-actuating screw member 33 of the lifting unit 3' have identical cross sectional shapes which are non-circular, and, in this embodiment, all of them are rectangular in cross section.

The second embodiment has the following additional advantages. Firstly, the nut 27 connected to the extending portion 213 of the securing connector 21 can prevent the securing connector 21 and the second fastener 26 from becoming loose. Secondly, because the first threaded rod 321' and the second threaded rod 323 move upward simultaneously, the lifting speed of the lifting device 100 can be increased.

In the description above, for the purposes of explanation, numerous specific details have been set forth in order to provide a thorough understanding of the embodiments. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what are considered the exemplary embodiments, it is understood that this disclosure is not limited to the disclosed embodiment but is intended to cover various arrangements included within the spirit and scope of the broadest interpretation so as to encompass all such modifications and equivalent arrangements.

What is claimed is:

1. A lifting device adapted for being connected between a seat body and a carrier, and drivable to move the carrier upward or downward relative to the seat body, said lifting device comprising:

a guide unit adapted for being connected between the seat body and the carrier, being extendable and retractable along a top-bottom direction, and defining an inner space extending along the top-bottom direction;

a support unit disposed in said inner space and including:

a securing connector that is adapted for being fixed to the seat body and that is made of an elastic material, a support tube that has a bottom portion connected to said securing connector, and that extends along the top-bottom direction, and a support member that is disposed at a top portion of said support tube and that has a connecting hole which is spatially communicated with the inside of said support tube; and a lifting unit including:

a first rod-actuating screw member that is disposed on said support member inside said inner space, and that has a first threaded hole aligned with said connecting hole, and a threaded rod unit that is adapted for being connected to the carrier and that includes a first threaded rod which extends through said first threaded hole into said support tube, and which is threadedly engaged with said first threaded hole of said first rod-actuating screw member in such a manner that said first threaded rod is rotatable by an external force and movable along the top-bottom direction, wherein:

all of said first rod-actuating screw member, said support member, and said guide unit have identical cross sectional shapes which are non-circular;

said securing connector of said support unit has a main body portion disposed inside said support tube in abutment with an inner tube surface of said support tube, and a flange portion protruding laterally from said main body portion and disposed outwardly from said support tube to abut against a bottom edge of said support tube;

said support unit further includes at least one first fastener securing said main body portion of said securing connector to said support tube;

said securing connector of said support unit further has an extending portion that extends downwardly from a bottom portion of said main body portion; and said support unit further includes:

a securing plate that is disposed below said support tube to abut against said securing connector, that is adapted for being connected to the seat body, and that has a through hole to receive and engage with said extending portion of said securing connector, and a second fastener that extends into said extending portion of said securing connector to secure said securing connector to said securing plate.

2. The lifting device as claimed in claim 1, wherein said securing connector of said support unit is made of polyamide 6.

3. The lifting device as claimed in claim 1, wherein: said first threaded rod of said threaded rod unit of said lifting unit is hollow and has an inner surface that defines a plurality of guiding grooves each extending along the top-bottom direction;

said lifting unit further includes a second rod-actuating screw member fixed to a top portion of said first threaded rod and capable of permitting rotation of said first threaded rod, said second rod-actuating screw member having a second threaded hole;

said threaded rod unit further includes:

a second threaded rod that extends into said first threaded rod and threadedly engages said second threaded hole, and that has a top end adapted for being connected to the carrier, and a coupling member that is connected to a bottom end of said second threaded rod and that has a plurality of protruding blocks which are respectively and slidably engaged with said guiding grooves;

wherein, said second threaded rod is drivable by the external force and rotatable to drive rotation of the coupling member, which in turn cause said first threaded rod to rotate, such that said first threaded rod and said second threaded rod move telescopically along the top-bottom direction; and wherein said second rod-actuating screw member and said guide unit have identical cross sectional shapes.

4. The lifting device as claimed in claim 3, wherein said lifting unit further includes a ball bearing that is connected between said second rod-actuating screw member and said first threaded rod to permit rotation of said first threaded rod without translational motion.

5. The lifting device as claimed in claim 1, wherein said threaded rod unit of said lifting unit further includes an annular sleeve sleeved on a bottom portion of said first threaded rod and disposed between said first threaded rod and said support tube to prevent said first threaded rod from colliding said support tube.

6. The lifting device as claimed in claim 1, wherein said guide unit includes:

a first guide tube extending along the top-bottom direction, adapted for being connected to the seat body, and having a top portion, a guide sleeve disposed inside and connected to said top portion of said first guide tube, and a second guide tube adapted for being connected to the carrier, slidably extending through said guide sleeve into said first guide tube, and cooperating with said first guide tube to define said inner space.

7. The lifting device as claimed in claim 1, wherein all of said guide unit, said support member of said support unit and said first rod-actuating screw member of said lifting unit are rectangular in cross section.

8. A lifting device adapted for being connected between a seat body and a carrier, and drivable to move the carrier upward or downward relative to the seat body, said lifting device comprising:

a guide unit adapted for being connected between the seat body and the carrier, being extendable and retractable along a top-bottom direction, and defining an inner space extending along the top-bottom direction;

a support unit disposed in said inner space and including:

a securing connector that is adapted for being fixed to the seat body and that is made of an elastic material, a support tube that has a bottom portion connected to said securing connector, and that extends along the top-bottom direction, and a support member that is disposed at a top portion of said support tube and that has a connecting hole which is spatially communicated with the inside of said support tube; and a lifting unit including:

a first rod-actuating screw member that is disposed on said support member inside said inner space, and that has a first threaded hole aligned with said connecting hole, and a threaded rod unit that is adapted for being connected to the carrier and that includes a first threaded rod which extends through said first threaded hole into said support tube, and which is threadedly engaged with said first threaded hole of said first rod-actuating screw member in such a manner that said first threaded rod is rotatable by an external force and movable along the top-bottom direction, wherein:

all of said first rod-actuating screw member, said support member, and said guide unit have identical cross sectional shapes which are non-circular;

said first threaded rod of said threaded rod unit of said lifting unit is hollow and has an inner surface that defines a plurality of guiding grooves each extending along the top-bottom direction;

said lifting unit further includes a second rod-actuating screw member fixed to a top portion of said first threaded rod and capable of permitting rotation of said first threaded rod, said second rod-actuating screw member having a second threaded hole;

said threaded rod unit further includes:

a second threaded rod that extends into said first threaded rod and threadedly engages said second threaded hole, and that has a top end adapted for being connected to the carrier, and a coupling member that is connected to a bottom end of said second threaded rod and that has a plurality of protruding blocks which are respectively and slidably engaged with said guiding grooves;

said second threaded rod is drivable by the external force and rotatable to drive rotation of the coupling member, which in turn cause said first threaded rod to rotate, such that said first threaded rod and said second threaded rod move telescopically along the top-bottom direction; and said second rod-actuating screw member and said guide unit have identical cross sectional shapes.

9. The lifting device as claimed in claim 8, wherein said securing connector of said support unit is made of polyamide 6.

10. The lifting device as claimed in claim 8, wherein said lifting unit further includes a ball bearing that is connected between said second rod-actuating screw member and said first threaded rod to permit rotation of said first threaded rod without translational motion.

11. The lifting device as claimed in claim 8, wherein said threaded rod unit of said lifting unit further includes an annular sleeve sleeved on a bottom portion of said first threaded rod and disposed between said first threaded rod and said support tube to prevent said first threaded rod from colliding said support tube.

12. The lifting device as claimed in claim 8, wherein said guide unit includes:

a first guide tube extending along the top-bottom direction, adapted for being connected to the seat body, and having a top portion, a guide sleeve disposed inside and connected to said top portion of said first guide tube, and a second guide tube adapted for being connected to the carrier, slidably extending through said guide sleeve into said first guide tube, and cooperating with said first guide tube to define said inner space.

13. The lifting device as claimed in claim 8, wherein all of said guide unit, said support member of said support unit and said first rod-actuating screw member of said lifting unit are rectangular in cross section.

* * * * *